United States Patent [19]

Drass

[11] 3,950,049

[45] Apr. 13, 1976

[54] CABINET MOUNTING STRUCTURE

[76] Inventor: Patrick E. Drass, 9507 Atom Road, Clinton, Md. 20735

[22] Filed: Dec. 23, 1974

[21] Appl. No.: 535,787

Related U.S. Application Data

[63] Continuation of Ser. No. 393,305, Aug. 31, 1973, abandoned.

[52] U.S. Cl. ..... 312/245; 312/198

[51] Int. Cl.[2] ..... A47B 67/02

[58] Field of Search ..... 312/111, 245, 198, 279, 312/140.1; 52/122, 312, 471; 248/224

[56] References Cited

UNITED STATES PATENTS

| | | | |
|---|---|---|---|
| 2,007,184 | 7/1935 | Dunning | 312/111 |
| 2,191,116 | 2/1940 | Osuch | 312/245 |
| 2,349,541 | 5/1944 | Earle | 312/198 |
| 2,489,493 | 11/1949 | Kuenzie | 312/111 |
| 2,521,134 | 9/1950 | Stanitz | 312/245 |
| 2,595,752 | 5/1952 | Batts | 248/224 |
| 2,599,322 | 6/1952 | Drain | 312/198 |
| 2,661,995 | 12/1953 | Knuth | 312/111 |
| 2,733,887 | 2/1956 | Schmidt | 312/254 |
| 3,042,978 | 7/1962 | Eames et al. | 312/245 |
| 3,256,053 | 6/1966 | Levenberg | 312/245 |
| 3,458,242 | 7/1969 | Williams | 312/263 |

*Primary Examiner*—Casmir A. Nunberg
*Attorney, Agent, or Firm*—Witherspoon and Lane

[57] ABSTRACT

Apparatus for mounting cabinets such as kitchen cabinets is disclosed. In addition, apparatus to provide for the mounting of trim panels above cabinets is disclosed. The cabinet mounting structure disclosed includes interlocking channel apparatus for mounting cabinets to walls and apparatus for mounting one cabinet to another cabinet with an adjustable space between the cabinets. The structure disclosed for accommodating trim panels above the cabinets comprises channel apparatus having formed therein channels for slidably housing the trim panels. The apparatus of this invention provides for a complete cabinet installation.

8 Claims, 12 Drawing Figures

CABINET MOUNTING STRUCTURE

This is a continuation of application Ser. No. 393,305, filed Aug. 31, 1973, now abandoned.

BACKGROUND OF THE INVENTION

This invention relates to the mounting of cabinets such as kitchen cabinets, and more particularly to apparatus for mounting cabinets such as kitchen cabinets and to related apparatus to provide for a complete cabinet installation.

Since the early 1950's the United States has experienced a tremendous growth in the home building industry. A very large number of housing units, both the multi-family and single family type housing units, are constructed yearly.

The growth in the home building industry has brought forth many new and innovative building techniques and tools. Unfortunately, no new completely satisfactory methods or apparatus for mounting cabinets such as kitchen cabinets have been devised. In a vast majority of installations, cabinets such as kitchen cabinets are mounted today using the techniques and apparatus used in the past. That is, the interior wall is put in place and the cabinets are then mounted on the wall using screws or other suitable fasteners. In the past, when most if not all interior walls of a housing unit were plaster walls with the wood lathing on which the plaster is spread, this method of mounting cabinets did not present too great a problem. Today, plaster is rarely used for interior walls in housing units. Plasterboard, or other types of wallboard are used to construct interior walls. However, cabinets are still fastened directly to the interior wall, now wallboard, by means of screws or the like. If a wall stud is available, the installer might use the wall stud for mounting a cabinet. However, stud spacing is such that rarely will wall studs be available for mounting all the cabinets; and if it is difficult to locate the studs, installation costs will not permit taking the time to locate the studs. The wallboard, such as plasterboard, generally used today is not really well suited to hold the weight of a cabinet such as a kitchen cabinet fully loaded with dishes and the like. Cabinets have often become loose and there have been many instances where a cabinet has actually fallen, particularly after the cabinet has been mounted for awhile. Steps usually taken to insure that the cabinets will remain securely fastened require additional materials and labor; and therefore, add to the costs of installation.

Another problem present in the cabinet mounting industry today is brought about by the present wide spread use of short cabinets. In order that the shelves of these shorter cabinets can be reached by a person of average height, they are mounted at such a level that a space remains between the top of the cabinet and the ceiling. This space is generally a dust collection area and is difficult to keep clean. To overcome this problem, some builders install false ceilings above the cabinets. This, of course, adds to the costs of the housing units. Very often, when the builder does not close in this area, the owner of the housing unit will enclose this space himself or will contract to have a carpenter do the work. This, of course, is an added expense to the owner.

Another problem in the cabinet installing trade is the difficulty encountered in attempting to provide, where necessary, a spacing between cabinets. The size of a given room may be such that a small or sizeable gap may occur between the end cabinet and the adjacent wall. A much neater appearance is presented if the cabinets extend all the way across a wall without a gap between the end of the last cabinet and the wall at right angles to the wall on which the cabinets are mounted. Not only can such a gap be unsightly, but it can also be difficult to properly clean this area. If two or more cabinets are spaced apart to close the gap, a trim board must be added to close the gap between the cabinets or a trim board must be added between the end of the last cabninet and the wall. Using today's techniques, this is not an easy task.

There are, of course, various methods and various different types of apparatus disclosed in the prior art to mount cabinets such as kitchen cabinets. These prior art cabinet mounting techniques are generally attempts to overcome some or all of the problems discussed above. However, these prior art attempts have apparently not been completely satisfactory since most cabinets are still mounted in the old manner discussed above.

This invention provides the method and apparatus for a complete cabinet installation. The method and apparatus of this invention overcomes all the present problems discussed above. Furthermore, using the apparatus and the techniques taught by this invention will reduce the time it takes to completely install a set of cabinets and should, therefore, materially decrease the costs of installation.

SUMMARY OF THE INVENTION

The cabinet installation apparatus of this invention comprises a pair of mating channel members for mounting one or more cabinets on a wall, a keyed female and accompanying male member for mounting one cabinet to a second cabinet, and channel members for removably holding panel members between the tops of cabinets and the ceiling. All of this apparatus can be used together in the installation of a set of cabinets, such as kitchen cabinets or the wall mounting members the members for mounting one cabinet to another or the panel holding channels can be used separately.

The members for mounting one cabinet to another are so designed that the distance between the cabinets can be varied, and these members have channels for holding trim or dress panels.

The panel holding channels are so designed that a long single panel can be used. However, for ease of installation and handling, separate shorter panels are preferable. A trim member that interlocks with the panel holding members is provided between the panels when a plurality of panels are provided. In addition, termination clips and corner clips for use with the panel holding channels are provided.

DESCRIPTION OF THE DRAWING

A complete understanding of the invention can be obtained from the following detailed description of the invention when read in conjunction with the annexed drawing in which like parts in the various figures have like numerals and in which.

DETAILED DESCRIPTION OF THE INVENTION

Figure 1:
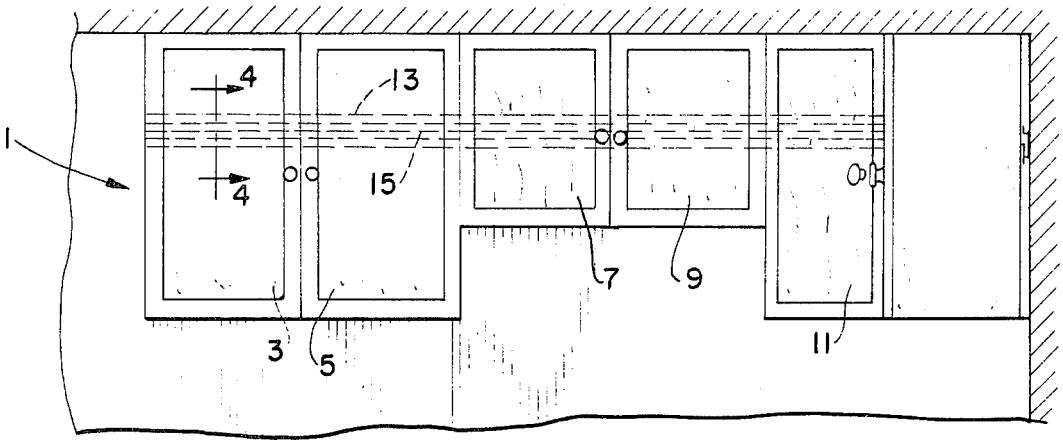
FIG. 1 shows a set of kitchen cabinets mounted to a wall by means of the wall mounting members of this invention.

Referring to the drawings, FIG. 1 shows a set of conventional cabinets, such as kitchen cabinets, 1 comprising the individual cabinets 3, 5, 7, 9 and 11. These cabinets are mounted to a wall by means of the wall mounting members of this invention shown in detail in FIGS. 2, 3 and 4.

Figure 2:
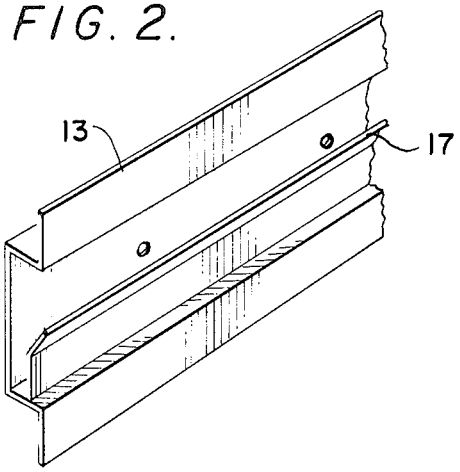
FIG. 2 shows a male wall mounting member constructed in accordance with this invention.
Figure 3:
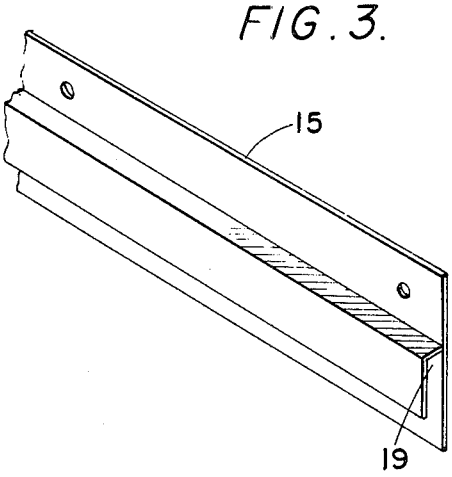
FIG. 3 shows a female wall mounting member constructed in accordance with this invention.
Figure 4:
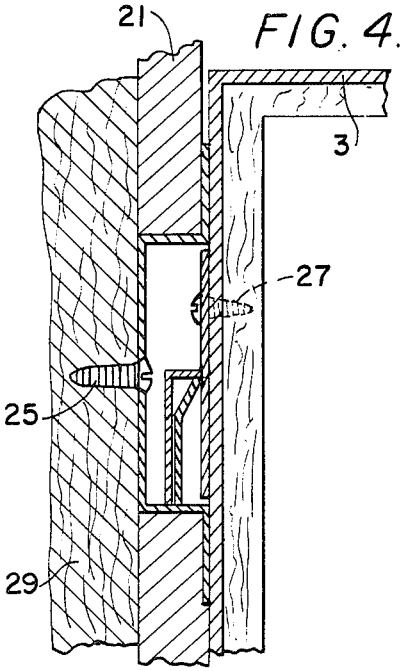
FIG. 4 is an end view taken along the line 4—4 in FIG. 1 showing how the wall mounting members of FIGS. 2 and 3 are used to mount cabinets to a wall.

As shown in FIGS. 2, 3 and 4, the wall mounting members comprise a male member or wall part 13 and a female member or cabinet part 15. Wall part 13 has a lip 17 which is inclined outwardly at its upper part, as is more clearly visible in FIG. 4. Cabinet part 15 has a channel 19 for receiving lip 17.

Referring specifically to FIG. 4, the parts 21 and 23 are wallboards or the like used for forming the interior walls of the room in which the set of cabinets 1 is installed. As is shown in FIG. 4, wallboard 21 is separated from wallboard 23 by wall part or male member 13. Male member 13 is shown secured to a wall stud 29 by means of a conventional screw 25 or the like. Of course, FIG. 4 shows only one end of members 13 and 15. In actual practice, wall member 13 will be a long metal piece that can be cut to the length of the set of cabinets 1. Male member 13 is then secured to every wall stud along its length.

Wall member 13 is metal and preferably is made from a metal such as aluminum or the like that is both strong and easily cut. Thus, member 13 can be manufactured in one standard length or several different lengths. It can then be cut if too long, or more than one piece can be used end to end.

Female member or cabinet part 15 is secured to the back wall of the cabinets by means of screws such as screw 27 or by any other suitable means. Cabinet member 15 is also made of a metal that is strong but easily cut. Thus, this part can also be cut to size and screwed to all the cabinets in the set. However, for ease of handling and installation, it is preferable that each cabinet be provided with a separate member 15 that each cabinet can be mounted separately. Cabinet member 15, or the number of these members, one for each cabinet, can be secured to the backs of the cabinets on the job; or preferably, the manufacturer of the cabinets could install a wall member of proper length to each cabinet. In this way, the cabinet manufacturer could supply a set of cabinets with a female member 15 mounted to each cabinet and a male member 13 would accompany each order of cabinets.

The men installing the wallboard in the house would cut the wallboard and leave a gap between sections 21 and 23 to accommodate member 13. In fact, these same persons could install member 13 while they are installing the wallboard or just leave a gap for the cabinet installer. After male member 13 is installed, each cabinet with its individual female member 15 is clipped or slipped over member 13 as shown in FIG. 4. Channel 19 fits over lip 17. The outward incline or bend in lip 17 facilitates the slipping of channel 19 over lip 17. From the foregoing it should be apparent that it is preferable to have individual members associated with each cabinet since a single cabinet can be easily hung on member 13 and slid in place. However, a long section of member 15 could be secured to all the cabinets and the set as a whole slipped onto male member 13. It should also be apparent that with members 13 and 15, the cabinets are readily mounted on a wall or removed; and that a sturdy mounting is obtained since the wall studs are used to secure member 13. Since the studs are exposed, there is no problem finding the studs.

Figure 5:
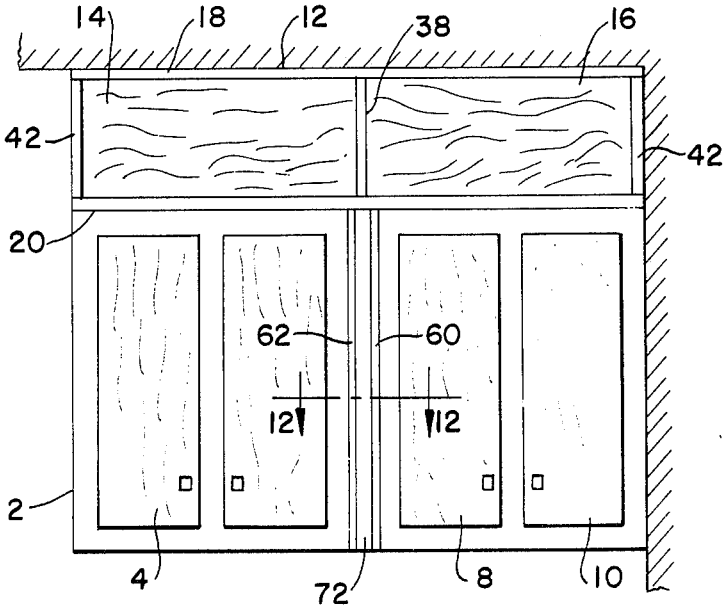
FIG. 5 shows a cabinet installation provided with the panel holding channels of this invention and the cabinet-to-cabinet mounting members of this invention.

FIG. 5 shows a second set of cabinets 2 having the four cabinets 4, 6, 8 and 10. Cabinets 4, 6, 8 and 10 are short cabinets and are mounted such that there is a space between the top of the cabinets and the ceiling 12. This space is enclosed by means of the panels 14 and 16. Panels 14 and 16 may be translucent with lighting behind the panels. Panels 14 and 16 would then act as light diffusers. Instead of translucent, panels 14 and 16 could be wood or the like stained or painted to match the cabinets or could be any desired color.

Figure 7:
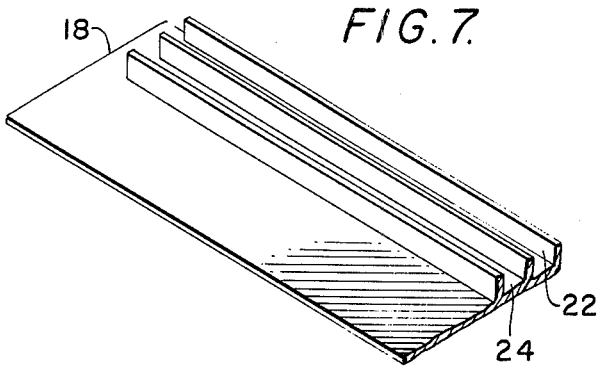
FIG. 7 shows a ceiling mounted panel holding channel member constructed in accordance with this invention.
Figure 8:
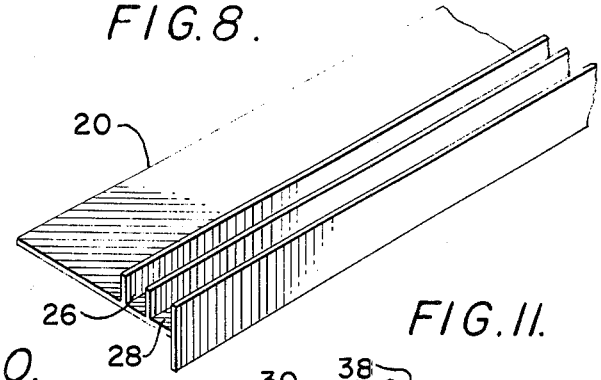
FIG. 8 shows a cabinet mounted panel holding channel member constructed in accordance with this invention.
Figure 11:
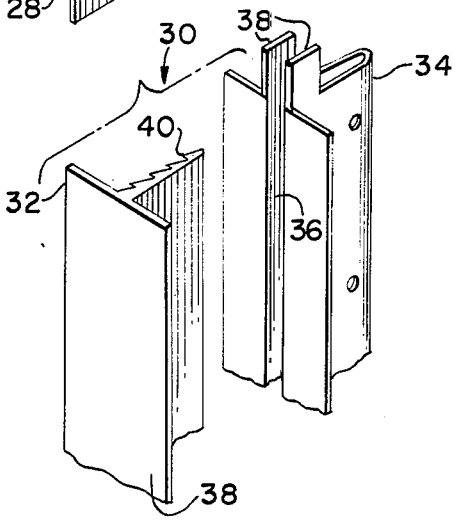
FIG. 11 shows a trim member or clip used between panels in the panel holding channels of FIGS. 7 and 8.

Panels 14 and 16 are slideably mounted in channel members 18 and 20 and are readily removed or put in place. Channel members 18 and 20 are shown in detail in FIGS. 7 and 8. FIG. 7 shows channel member 18 which, is mounted to the ceiling by screws or the like, as having two channels or grooves 22 and 24. Channel member 20 is shown in FIG. 8 as having the two grooves or channels 26 and 28. Channel member 20 is mounted to the top of the cabinets by means of screws or other suitable means in such a manner that the channels or grooves 26 and 28 are pointed upward away from the cabinets while channel member 18 is mounted to ceiling 12 with its channels or grooves 22 and 24 pointing downward toward the cabinets. Panels 14 and 16 are slid into the front grooves or channels 22 and 28 of members 18 and 20, respectively. Since two panels are provided, (for ease of handling and installation several shorter panels are preferred over a single long panel) the edges where the panels 14 and 16 meet will show. This may not present a neat appearance; and if the panels were a little short, an unsightly gap would be present. To cover the point where the panels meet or such a gap is present and to assist in holding the panels in place, a trim or divider clip 30, shown in detail in FIG. 11, is provided. Divider clip 30 consists of a male part 32 and a female part 34. Female part 34 has a U-shaped groove 34 and the tabs 38. A similar pair of tabs (not shown) are provided at the other end of part 34. Male part has face plate 38 and a member 40 extending back from face plate 38. Member 40 is ridged, as shown, to facilitate gripping when slid into groove 36. The tabs 38 of part 34 are pushed into the back groove or channel 24 of ceiling member 18, and the tabs at the other end fit into back groove or channel 26 of cabinet member 20 between the edges of panels 14 and 16. Part 32 is then pushed into groove 36 of part 34 and face plate 38 covers the edges of panels 14 and 16.

Figure 9:
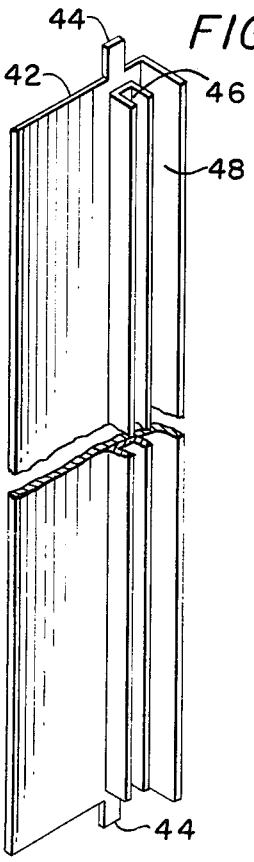
FIG. 9 shows an end member utilized with the panel holding channels of FIGS. 7 and 8.

At the opposite ends of panels 14 and 16, the edges of these panels next to the walls will also show. To cover these edges a termination clip 42, shown in detail in FIG. 9, is provided. Termination clip 42 has tabs 44 at each end and two channels or grooves 46 and 48. A termination clip 42 is provided on each end of the panel installation as shown in FIG. 5. The end panels 14 and 16 are slipped into the channel or groove 48 of their respective clips 42. The tabs 44 of clips 42 slide into the rear channels or grooves 24 and 26 of members 18 and 20.

Only a short section of channel members 18 and 20 is shown in FIG. 7. Full length channel members 18 and 20 can also have tabs. These tabs would extend downward on member 18 and upward on member 20 to slide into groove 44 of clip 42. This provides for a more secure interlocking of the parts, but requires that ceiling member 18 and cabinet member 20 be manufactured to specific lengths. Without such tabs, members 18 and 20 could be made into long strips of easily cut metal.

Figure 10:
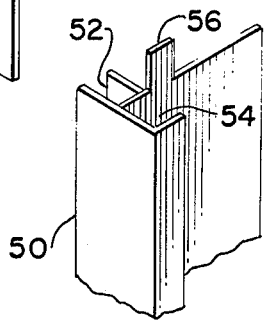
FIG. 10 shows a corner member used with the panel holding channel members of FIGS. 7 and 8.

In some cabinet installations, the set of cabinets are mounted on one wall and continue around on another wall so that there are really two sets of cabinets at right angles to each other. For such installations, a corner clip 50 is provided, as shown in FIG. 10. Corner clip 50 has a first channel or groove 52 and a second channel or groove 54 at right angles to channel or groove 52. A tab 56 is provided and a second such tab (not shown) is provided at the other end. These tabs lock into the second channel or groove of the ceiling and cabinet channel members, and panels such as panels 14 and 16 of FIG. 5 fit into the grooves or channels 52 and 54 of corner clip 50.

As was mentioned above, ceiling member 18 and cabinet member 20 can be made into any length from suitable, readily-cut material and cut to the proper length for a particular installation. Trim clip 20, termination clip 42 and corner clip 50, on the other hand, will have to be manufactured to specific lengths. This does not present a problem since the distance between the top of the cabinets and the ceiling can be controlled when the cabinets are installed.

Figure 6:
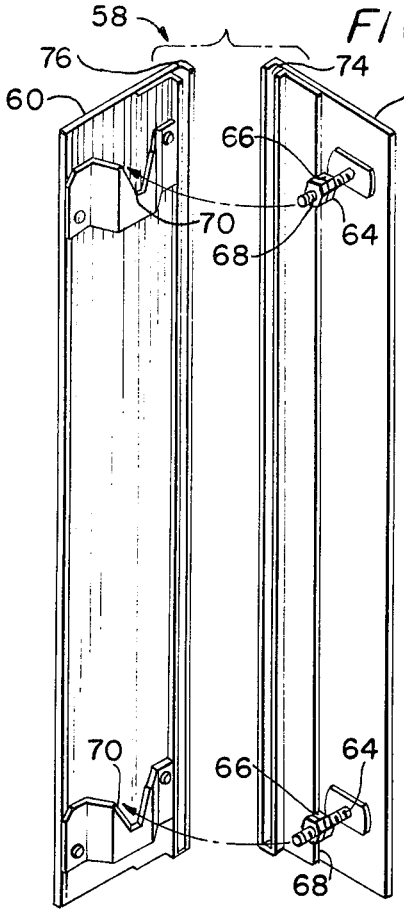
FIG. 6 shows a male member and mating female member for mounting one cabinet to another constructed in accordance with this invention.

In many cabinet installations, the distance between the cabinets or between two cabinets may have to be adjusted to have the set of cabinets cover a given area or extend from wall to wall. That is, it is sometimes desirable not to have two cabinets fit flush against each other because this would leave a gap between the end cabinet and the wall. In such cases, the middle two cabinets are generally separated and a trim board is placed between the cabinets to hide the gaps. This is not always an easy task. In order to be able to readily adjust the distance between two cabinets and readily hide the gap, this invention provides cabinet-to-cabinet mounting apparatus 58 shown in detail in FIG. 6. Mounting apparatus 58 has a first section 60 and a second section 62. Section 60 has a pair of members 70 having generally V-shaped grooves therein. This section is secured by screws or the like to the side wall of one cabinet. First section 60 also has a channel or groove 76 running its entire length. This groove is open at the top and closed at the bottom, as shown. Second section 62 carries a threaded bolt 64 near each of its ends. A pair of nuts 66 and 68 are provided on each bolt 64. Second section 62 also has a groove or channel 74, closed at the bottom and open at the top, running its entire length. Second section 62 is secured to a side wall of a second cabinet by screws or the like.

After the two sections 60 and 62 of apparatus 58 are fastened to their respective cabinets, bolts 64 are slipped into their respective V-shaped groove members 70 of section 60 with nuts 68 on the inside of members 70 and nuts 66 on the outside. These two nuts can then be adjusted to bring the cabinets closer together or farther apart within the limits of length of bolts 64 and the depth of members 60. This is very easily accomplished if the cabinets are mounted with the wall mounting apparatus of this invention, with each cabinet having its own cabinet member 15.

Figure 12:
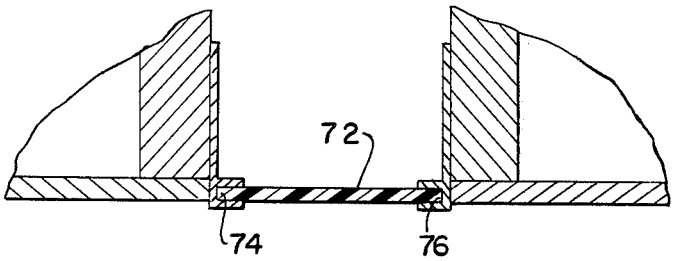
FIG. 12 shows the panel holding channels of the members of FIG. 6 with a panel member in place.

When the two cabinets are the proper distance apart, a piece of paneling or the like is cut to size and slipped into grooves 74 and 76. A panel 72 is shown in grooves 74 and 76 in FIG. 12. FIG. 5 shows a front view of this panel.

From the foregoing description, it should be apparent that this invention provides the apparatus and a method for readily installing or removing a set of cabinets. Furthermore, it should also be apparent that the various basic elements of the invention can be used separately or in any combination. That is, the wall mounting members can be used alone in a given installation, or the panel holding channel members and their associated clips can be used alone, or the cabinet-to-cabinet mounting apparatus can be used alone, and, of course any two of these or all three can be used together.

While the invention has been described with reference to specific structural details, it should be apparent to those skilled in the art that various modifications and changes can be made to these specific structural details without departing from the spirit and scope of the invention as set forth in the claims.

What is claimed is:

1. Mounting apparatus for mounting a cabinet to an interior wall, said interior wall having a gap therein exposing the wall studs, comprising:

a wall member, said wall member having a rectangular base, a first arm integrally formed with one of the long sides of said rectangular base and extending at substantially a right angle to said base, a second arm integrally formed with the other long side of said rectangular base and extending at substantially a right angle to said base, said base and said first and second arms forming substantially a U-shape, a flange integrally formed with said first arm and extending at substantially a right angle away from said second arm, a second flange integrally formed with said second arm and extending at substantially a right angle away from said first arm, a generally rectangular shaped coupling member secured along one of its long edges to the inside of said first arm, said coupling member being spaced apart from said base and extending from said first arm toward said second arm, the height of said coupling member being such that said coupling member does not extend the full distance between said first arm and said second arm, said coupling member also being substantially parallel with said base over a portion of its height going from said secured edge of said coupling member toward said second arm and then being inclined away from said base over the balance of its height;

means to secure said wall member in said gap to said exposed wall studs such that said first and second arms extend away from said wall studs and said flanges extend slightly over the outside of said interior wall on each side of said gap to thereby close said gap;

a cabinet member having a flat rectangular plate and an L-shaped member secured to the flat plate, said L-shaped member having a short arm extending at substantially a right angle to one of the surfaces of said flat plate and a long arm extending at substantially a right angle to said short arm and substantially parallel to said one surface of said flat plate; and means to mount said flat plate to the back wall of said cabinet such that said long arm of said L-shaped member points toward the bottom of said cabinet, whereby said L-shaped member is slipped over said coupling member to mount said cabinet on said interior wall.

2. The mounting apparatus as defined in claim 1 wherein a plurality of cabinets are provided each having one of said cabinet members secured to its rear wall and wherein each one of said plurality of cabinets are mounted on said wall member side-by-side in abutting relationship to form a set of cabinets by slipping said cabinet member of each said plurality of cabinets over said coupling member, said wall member being of sufficient length to accommodate all of said cabinet members.

3. The mounting apparatus as defined in claim 1 wherein a plurality of cabinets are provided and wherein a cabinet member is secured to all of said plurality of cabinets with said cabinets aligned side-by-side in an abutting relationship, whereby said plurality of cabinets are mounted on said interior wall as a set of cabinets by slipping said cabinet member on said wall member, said wall member being sufficiently long to accomodate said cabinet member.

4. Mounting apparatus as defined in claim 2 wherein said gap in said interior wall is so positioned that the top of said cabinets are spaced apart from the ceiling associated with said interior wall on which said cabinets are mounted.

5. Mounting apparatus as defined in claim 4 including a first channel member having two parallel longitudinal channels, means to mount said first channel member on top of said cabinets such that the base of said two longitudinal channels abuts the top of said cabinets, a second channel member having two parallel longitudinal channels, means to mount said second channel member on the ceiling associated with said interior wall on which said cabinets are mounted such that the base of said two channels of said second channel member abuts said ceiling, at least one panel member slideably mounted in the front-most channel of both said first and second channel members, and termination clips positioned at each end of said panel, said termination clips being L-shaped and having a longitudinal channel inside said L-shape and having a tab at each end, said tabs mating with the longitudinal parallel channel of said first and second channel members behind said channels in which said panel is slideably mounted, each end of said panel mating with said channel of a termination clip.

6. Mounting apparatus as defined in claim 5 wherein a plurality of panels are slideably mounted in said front-most channels of said first and second channel members and wherein a trim clip is positioned between the abutting ends of each said plurality of panels.

7. Mounting apparatus as defined in claim 5 wherein two of said plurality of cabinets are spaced apart and means are provided to mount a side wall of one of said two spaced apart cabinets to the adjacent side wall of the other of said two spaced apart cabinets, said means to mount said side wall of one of said two spaced apart cabinets to the side wall of the other of said two spaced apart cabinets comprising a first plate having a longitudinal channel along one side, said longitudinal channel being closed at the bottom and open at the top, and a pair of generally U-shaped plates having substantially U-shaped grooves, one secured adjacent each end of said first plate; means to secure said first plate to the side wall of one of said two spaced apart cabinets such that said U-shaped plates having said U-shaped grooves extend away from said side wall to which said first plate is fastened; a second plate having a longitudinal, closed at the bottom and open at the top, channel along one side thereof and a threaded bolt adjacent each end thereof for mating with said U-shaped grooves; first and second nuts threaded on each of said threaded bolts; means to secure said second plate to the side wall of the other of said two spaced apart cabinets such that said bolts extend toward said first plate, said threaded bolts mating with said U-shaped grooves such that said first nut of each said threaded bolts is inside its mating U-shaped plate and said second nut of each said threaded bolt is outside of its respective U-shaped plate, whereby said nuts can be adjusted to adjust the space between said two spaced apart cabinets; and a panel slideably mounted in said channels of said first and second plate such that its outside surface is substantially flush with the front surfaces of said two spaced apart cabinets.

8. Mounting apparatus as defined in claim 7 including a second plurality of cabinets mounted on a wall at right angles to said plurality of said cabinets, each said second plurality of cabinets having secured thereto one said cabinet member, the studs of said right angle wall having a wall member secured thereto whereby said second plurality of cabinets are mounted on said right angle wall by sliding said cabinet member of each said cabinet over said wall member, one of said first channel members associated with said second plurality of cabinets; one of said second channel members associated with said second plurality of cabinets; at least one panel slideably mounted in said channel members associated with said second plurality of cabinets; a corner clip having a first channel for receiving the end of said panel adjacent said right angle wall; a second channel at a right angle to said first channel of said corner clip for receiving one end of said at least one panel associated with said second plurality of cabinets; and a tab located at each end of said corner clip for securing said corner clip to said first channel member and said second channel member associated with said plurality of cabinets.

* * * * *